US006715482B2

(12) United States Patent
Hunault et al.

(10) Patent No.: US 6,715,482 B2
(45) Date of Patent: Apr. 6, 2004

(54) GAS COOKING APPLIANCE

(75) Inventors: Patrick Hunault, Montbazon (FR); Bernard Dane, Montbazon (FR)

(73) Assignee: Sourdillon (FR)

( * ) Notice: Subject to any disclaimer, the term of this patent is extended or adjusted under 35 U.S.C. 154(b) by 0 days.

(21) Appl. No.: 10/124,086

(22) Filed: Apr. 17, 2002

(65) Prior Publication Data

US 2002/0153001 A1 Oct. 24, 2002

(30) Foreign Application Priority Data

Apr. 18, 2001 (FR) ..... 01 05232

(51) Int. Cl.[7] ..... F24C 3/00

(52) U.S. Cl. ..... 126/39 R; 126/214 R; 126/214 A

(58) Field of Search ..... 126/39 R, 214 R, 126/214 A, 39 K, 39 E; 431/354

(56) References Cited

U.S. PATENT DOCUMENTS

| | | | | | |
|---|---|---|---|---|---|
| 4,953,534 | A | * | 9/1990 | De Gouville et al. | 126/39 H |
| 5,623,917 | A | * | 4/1997 | Dinaso et al. | 126/39 H |
| 5,628,302 | A | * | 5/1997 | Schatz et al. | 126/39 R |
| 5,676,539 | A | * | 10/1997 | Draper | 431/354 |

FOREIGN PATENT DOCUMENTS

| | | | |
|---|---|---|---|
| EP | 0551235 | | 7/1993 |
| FR | 2 642 148 | * | 7/1990 |
| WO | WO 9606304 | | 2/1996 |

* cited by examiner

*Primary Examiner*—Alfred Basichas
(74) *Attorney, Agent, or Firm*—Piper Rudnick LLP

(57) ABSTRACT

Gas cooking appliance equipped with a top plate (1) supporting at least one gas burner (4), characterized in that the said gas burner (4) comprises a gas injector (6) which is fastened to the top plate (1) in a part (11) thereof which projects above the rest of the plate, and which especially may be in the form of a plateau or of a boss.

6 Claims, 3 Drawing Sheets

FIG. 1.
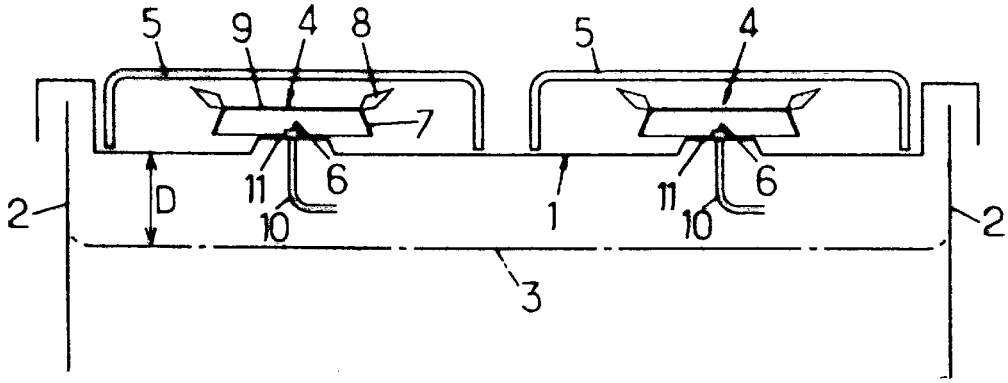
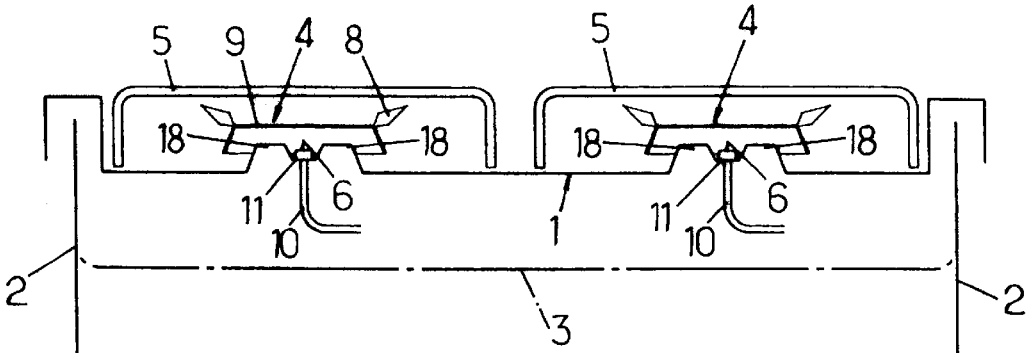
FIG. 2.

FIG.3A.
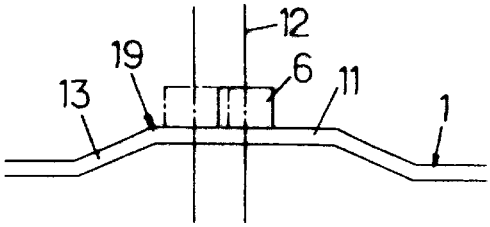
FIG.3B.
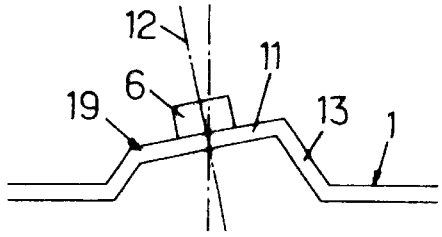
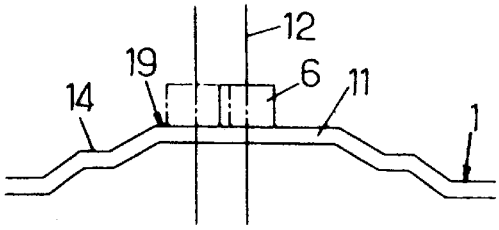
FIG.4A.
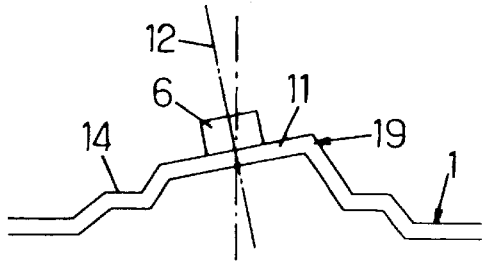
FIG.4B.

GAS COOKING APPLIANCE

FIELD OF THE INVENTION

The present invention relates to improvements made to gas cooking appliances equipped with a top plate supporting at least one gas burner.

DESCRIPTION OF THE PRIOR ART

In general, the burners used in domestic or professional cooking appliances comprise a head or body equipped with a lid acting as a cap. This assembly constitutes the upper part of the burner where the flames are generated in the form of a single or double ring. Using developments suitable for constructing burners of the "flat" type, the aforementioned assembly may include an annular venturi defined between the faces opposite the head and the lid.

The lower part of the burner comprises an injector and is generally arranged in the form of an injector-holder which may either be constructed as an independent component fastened under the top plate of the appliance, or be made integrally with the top plate by hollow pressing thereof.

Whatever the construction of the injector-holder thus produced, the injector-holder appears as a cavity located below the plane of the top plate: the result of this is that this cavity collects the liquid overflows and thus its cleaning proves to be difficult.

An additional drawback lies in the height presented by such an arrangement: although its height (for example typically about 30 mm under the top plate) is especially small compared to the height of a burner of conventional design with a tubular venturi under the top plate, it nevertheless remains that this height under the top plate, although small, is not imposed by operational constraints of the burner and rather results from a practice which is widespread in the prior art.

SUMMARY OF THE INVENTION

However, there are pressing demands both from users for burners which are easier to maintain and to clean and from kitchen equipment manufacturers for cooking appliances of an even smaller height or extra flat and having as low a cost price as possible.

The invention aims to satisfy these needs.

To this end, a gas cooking appliance equipped with a top plate supporting at least one gas burner, being arranged according to the invention, is characterized in that the said gas burner comprises a gas injector which is fastened to the top plate in a part thereof which projects above the rest of the plate and this projection is in the form of a plateau.

Using this arrangement, the underlying cavity or pot of the burner, to the bottom of which the injector was conventionally fastened, is removed: the liquid overflows run directly over the generally flat top plate (with the exception of the part of positive elevation supporting the injector) and cleaning this flat surface is very easy.

Furthermore, by removing this pot, the burner assembly is now of small height, since all the constituent elements are located above the top plate, while it is possible, without affecting the operation of the burner, to keep the cap at substantially the same level as in the prior burners. In other words, removal of the pot does not lead to increasing the height of the burner above the top plate.

Finally, removing the pot removes a component part or an operation of forming the pot present in the prior burners, which is accompanied by a reduction in the cost of manufacturing the burner.

In one possible embodiment, the part of the top plate to which the injector is fastened and which projects above the rest of the plate is in the form of a plateau.

In another possible embodiment, the part of the top plate to which the injector is fastened and which projects above the rest of the plate is in the form of a boss, especially in the form of a spherical or hemispherical dome of upwardly oriented convexity.

The fact that the part supporting the injector is in the form of a region, stamped in positive relief, of the top plate proves to be particularly beneficial from the point of view of reducing the vertical size, since it is in the cavity defined by the said region under the top plate that the gas supply tube starts its bend and is connected to the injector.

Preferably, the part of the top plate to which the injector is fastened comprises upwardly projecting bosses distributed around the injector: the presence of these projecting bosses provides safety while preventing the cleaning element (cloth, sponge, etc.) coming into contact with the orifice of the injector, and producing a deposit which risks obstructing it, during cleaning of this part supporting the injector.

It is possible to envisage that the part for fastening the injector is constructed in the form of a component connected to the top plate.

However, it is also possible to envisage that the part for fastening the injector is integral with the top plate and is a stamped part thereof: this solution is particularly advantageous since it can be obtained by a single stamping operation together with the general stamping for shaping the plate and avoids a step of assembling a separate component.

The arrangements of the invention easily lend themselves to particular structural features required by certain manufacturers of cooking equipment: according to the required demands, the part for fastening the injector may be shaped so that the axis of the injector is substantially perpendicular to the top plate along the axis of the ring of the burner or off-axis (if the design of the latter allows it), or else may be shaped so that the axis of the injector is inclined with respect to a perpendicular to the top plate, without resulting in particular and/or additional manufacturing difficulties, whether the said part is a connected component or is integral with the top plate.

BRIEF DESCRIPTION OF THE DRAWINGS

The invention will be better understood on reading the following detailed description of some embodiments given solely by way of non-limiting example. In this description, reference will be made to the appended drawings in which:

FIGS. 1 and 2 are very schematic side views illustrating, respectively, three arrangements of a cooking appliance made according to the invention, and FIGS. 3A, 3B; 4A, 4B; 5A, 5B; 6; and 7A, 7B are very schematic views respectively illustrating diverse variants for implementing the provisions of the invention.

DETAILED DESCRIPTION OF THE INVENTION

Figure 5A:
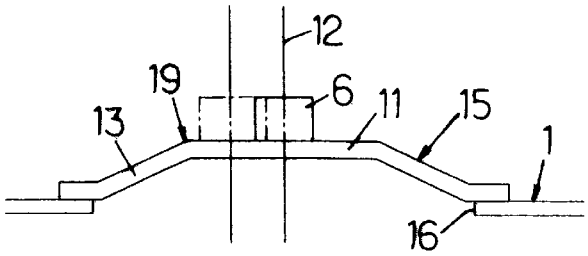

With reference first of all to FIG. 1, a gas cooking appliance of the domestic type equipped with a top plate 1, which rests on side walls 2 is shown therein very schematically. A bottom plate 3 separates the upper part of the appliance, more specifically aimed at by the invention, from the underlying part which may be of any sort (especially which may be either another part of the gas appliance—an oven in the case of a cooker, for example—or be another household appliance or a unit in the case of a cooking appliance of the flat or "top" type).

The top plate 1 supports at least one gas burner 4, and in general several burners (two burners can be seen in FIG. 1). Each burner 4 is surmounted by a grid 5 (shown individually, but could be common to all the burners) intended to support containers.

According to the invention, each part 11 of the top plate 1 intended for mounting an injector 6 has a positive elevation with respect to the rest of the plate, that is to say is raised with respect to the rest of the plate 1 as illustrated in FIG. 1. In the embodiment illustrated, the raised part 11 is in a flat shape, in other words consists of a plateau rising above the rest of the plate 1. The injectors 6 of the burners are fastened directly to the raised parts 11 of the top plate 1.

Each injector 6 opens out into a mixing chamber defined by a burner body 7 surmounting the raised part 11 of the top plate and having a peripheral ring for passage of flames 8. The body 7 is closed above by a lid 9 forming a cap. The annular surfaces facing the body 7 and the lid 9 are shaped, in a manner known per se, in order to define a divergent annular passage forming a radial annular venturi, of the flat type.

Such a burner may be made very flat, such that its lid 9 is located approximately at the same level, above the top plate, as for a prior burner.

The arrangement which has just been described removes the cavity or pot underlying the top plate, to the bottom of which the injector was fastened. This results in savings in component parts, and therefore in cost price, and it also results in greater ease of cleaning in the case of overflows.

In addition, because the injector 6 is lifted to the level of the top plate, this also results in saving space under the top plate 1, with a distance D between the top plate 1 and the bottom plate 3 which may be substantially reduced with respect to the prior appliances: it is then possible to leave remaining only just enough space needed for the bent gas supply pipes 10 which are connected to the injectors 6. It is then possible to produce gas cooking appliances of the extra flat type, having a height which is substantially less than that of the current appliances.

FIG. 3A illustrates, on an enlarged scale and very schematically, the part 11 of the top plate 1 to which the injector 6 is fastened. The axis 12 of the injector 6 is, in this case, substantially perpendicular to the entire plate 1.

For reasons of safety, provision may be made for the injector 6 to be inclined to the vertical. In this case, provision can be made, as illustrated in FIG. 3B, for the top plate 1 to be stamped so that each part 11 intended for fastening an injector 6 is inclined with respect to the general plane of the plate 1. The injector 6 is then fastened to the plate 1 with its axis 12 remaining substantially perpendicular to the assembly part 11, but which is inclined with respect to the vertical.

As illustrated in FIG. 3A, it is also possible to make sure that the injector 6 is fastened to the assembly part 11 while being offset laterally (shown in mixed line) with respect to the burner body centred on the axis 12.

Such an arrangement has the benefit of protecting the injector 6 from considerable liquid overflows: because of its raised position on an island, the injector 6 does not risk seeing liquid entering its orifice. Furthermore, the plate can be cleaned easily.

Finally, because the injector is located above the underlying cavity defined by the plateau 19, the bent tube connected to the injector may pass close to the lower face of the top plate: producing an extra flat appliance is thus made easier.

Producing the plateau 19 may give rise to diverse variants, either with smooth flanks 13 defining a frustoconical surface (FIGS. 3A and 3B), or with flanks 14 in successive tiers defining a succession of frustoconical surfaces as illustrated in FIGS. 4A and 4B.

Each assembly part 11 of an injector 6 may very advantageously be integral with the top plate 1, that is to say, be a region of the said plate 1 which is possibly stamped to obtain the desired shape and/or relief. The desired shape may, in practice, be stamped during the operation of shaping the whole top plate, such that this stamping does not lengthen the manufacturing time, since it does not involve a specific operation.

Figure 5B:
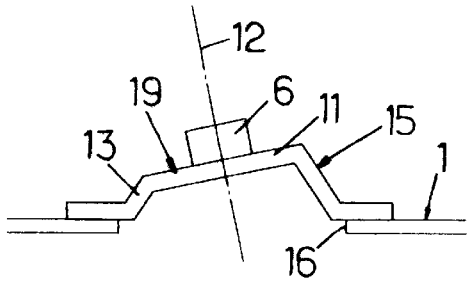

However, without departing from the scope of the invention, it is also possible to envisage that each assembly part 11 of an injector is constructed in the form of a particular component 15 fastened to a cutout 16 of the top plate 1 as illustrated in FIGS. 5A and 5B respectively showing connected components 15 in the form of a plateau 19 in which the assembly part 11 of the injector is parallel to the plate 1 and inclined with respect to the plate 1, respectively.

Figure 6:
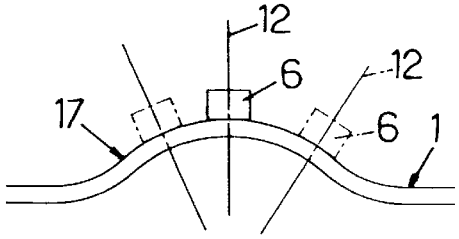

The provisions of the invention are not limited to a configuration of the assembly part 11 of the injector in a form which is flat and parallel to the plate 1 or inclined to the latter. Provision may also be made for this part 11 to be provided in the form of a projection of curvilinear cross section, especially a spherical or hemispherical dome-shaped boss 17, as illustrated in FIG. 6. The injector 6 may then be assembled at the top of this boss 17, in which case, if the boss is of regular and symmetrical shape, the axis 12 is perpendicular to the plate 1; or else it may be assembled in an offset position, on the flank of the boss, in which case its axis 12 is inclined, as illustrated in dotted line in FIG. 6. Such a boss-shaped structure may be manufactured without difficulty by directly stamping the top plate 1.

Figure 7A:
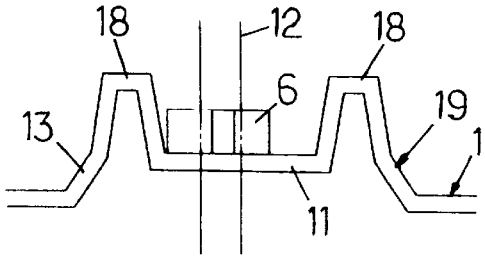
Figure 7B:
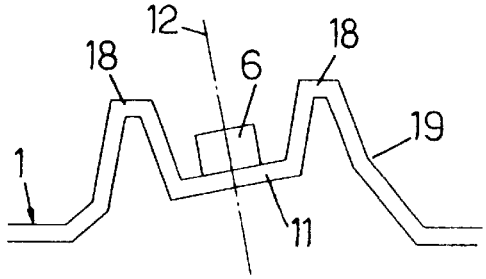

When cleaning the top plate, in order to avoid too marked a contact of the cleaning means (cloth, sponge, etc.) with the injector 6 and in order to avoid clogging the orifice thereof, it may be advantageous to provide several (for example three or four) protuberances or bosses 18 distributed over the periphery of the part 11 for assembling the injector 6. This provision is illustrated in FIG. 7A in the configuration of a part 11 for assembling the injector arranged in the form of a plateau parallel to the plate 1 and in FIG. 7B in the case where the said plateau is inclined. Since the protuberances or bosses 18 have a height substantially greater than the height of the injector, the orifice thereof is relatively protected. FIG. 2 illustrates schematically the overall configuration of a gas cooking appliance thus equipped.

It is useful to emphasize that the part 11 for assembling the injector 6, which is raised with respect to the rest of the top plate 1, has an elevation with respect to the plate which remains small (for example not exceeding 15 mm). Its production in integral form with the top plate 1, by stamping the latter, may then be carried out with relatively simple and low cost equipment.

What is claimed is:

1. A gas cooking appliance, comprising: at least one gas burner provided with a gas injector; and a top plate supporting the gas burner, wherein the top plate is provided with a plateau-shaped projection which projects above the rest of the top plate and on which the gas injector is fastened, and wherein the plateau-shaped projection is integral with the top plate and is a stamped part thereof.

2. The gas cooking appliance according to claim 1, wherein said plateau-shaped projection is arranged in such a manner that the axis of said injector which is fastened thereon is substantially perpendicular to said top plate.

3. Appliance according to claim 1, wherein this projection is in the form of a boss, especially in the form of a spherical or hemispherical dome of upwardly oriented convexity.

4. Appliance according to claim 1, wherein the part of the top plate, to which the injector is fastened, comprises upwardly projecting bosses distributed around the injector.

5. Appliance according to claim 1, wherein the part for fastening the injector is constructed in the form of a component connected to the top plate.

6. Appliance according to claim 1, wherein the part for fastening the injector is shaped so that the axis of the injector is inclined with respect to a perpendicular to the top plate.

* * * * *